United States Patent [19]

Ury

[11] Patent Number: 4,978,891

[45] Date of Patent: Dec. 18, 1990

[54] ELECTRODELESS LAMP SYSTEM WITH CONTROLLABLE SPECTRAL OUTPUT

[75] Inventor: Michael G. Ury, Bethesda, Md.

[73] Assignee: Fusion Systems Corporation, Rockville, Md.

[21] Appl. No.: 344,863

[22] Filed: Apr. 17, 1989

[51] Int. Cl.[5] ..... H05B 41/24; H01J 15/04

[52] U.S. Cl. ..... 315/117; 315/248; 315/326; 315/344; 315/151

[58] Field of Search ..... 315/248, 117, 118, 326, 315/344, 112, 151; 313/13

[56] References Cited

U.S. PATENT DOCUMENTS

| | | | |
|---|---|---|---|
| 3,604,500 | 9/1971 | Davis | 313/13 X |
| 3,786,308 | 1/1974 | Browner et al. | 315/248 |
| 4,256,404 | 3/1981 | Walker | 315/151 X |
| 4,431,947 | 2/1984 | Ferriss | 315/151 |
| 4,449,821 | 5/1984 | Lee | 356/319 |
| 4,485,332 | 11/1984 | Ury et al. | 315/112 X |
| 4,695,757 | 9/1987 | Ury et al. | 315/112 X |

*Primary Examiner*—Eugene R. LaRoche
*Assistant Examiner*—Ali Neyzari
*Attorney, Agent, or Firm*—Pollock, Vande Sande & Priddy

[57] ABSTRACT

An electrodeless lamp system and method for providing light output having a controlled spectral distribution. A lamp having a fill which is not fully vaporized at the lamp operating temperature and which emits in a characteristic region of the spectrum is used. A function generator generates a function signal, and the magnitude of the lamp output in the characteristic region or the ratio of such magnitude and a magnitude in a different characteristic region is compared with the function signal. The difference signal is used to control the amount of cooling gas which is incident on the lamp bulb to control the spectral distribution of the radiation which is emitted by the lamp.

20 Claims, 2 Drawing Sheets

ELECTRODELESS LAMP SYSTEM WITH CONTROLLABLE SPECTRAL OUTPUT

The present invention is directed to an electrodeless lamp system and method for providing light output having a controlled spectral distribution.

In the prior art, it has been difficult to provide a lamp having a spectral distribution which could be controlled independently of the total level of radiation which is outputted by the lamp. For example, in the case of an incandescent lamp, the spectrum changes along with magnitude of the radiation output. For illumination applications where independent spectral control has been required, it has been necessary to resort to physically cumbersome arrangements, for example, combinations of multiple lamps, each having a particular spectral output, wherein the illumination from the multiple lamps is mixed, or combinations of filters which modify the spectral content of the lamp output.

In accordance with the present invention, however, an electrodeless lamp having a controllable fill is utilized, which enables the spectral distribution of the lamp output to be controlled in a programmable fashion. Thus, the lamp unit is self contained, and it is not necessary to use external apparatus such as filters to effect modification of the spectrum.

At the present time, electrodeless lamps are well known, for example, see U.S. Pat. Nos. 4,485,332 and 4,683,525,assigned to Fusion Systems Corporation. Although such lamps emit light in both the ultraviolet and visible parts of the spectrum, in the past they have been used predominantly for their ultraviolet output. The present invention, however, relates primarily to the use of the visible part of the spectrum.

In accordance with the invention, an electrodeless lamp having a fill containing a substance which is not fully vaporized at the lamp operating temperature is used. This substance emits light in a characteristic region of the spectrum, for example, the red region. A function generator is provided to generate a signal for programming the amount of light output in the characteristic spectral region which is desired. The magnitude of the lamp output in the characteristic region is detected, and is compared with the magnitude of the function signal. If a difference is present, the difference signal is used to control the amount of cooling gas which is incident on the lamp bulb. The cooling control enables more or less of the incompletely vaporized fill substance to become vaporized, until the detected magnitude value equals or approaches the value of the function signal, meaning the desired output in the characteristic spectral region has been achieved.

In accordance with a further aspect of the invention, a ratio of the detected magnitude value in the characteristic spectral region and the magnitude value in a different characteristic spectral region is taken. This ratio is now compared to the function signal to create the difference signal. In this way, the spectral distribution over a relatively broad spectral range, for example, the visible part of the spectrum may be controlled by the invention. For example, in the preferred embodiment of the invention, the magnitude of the spectral output in the red region is divided by the magnitude of the spectral output in the green or blue region, which provides relatively complete control over the color of the visible light which is emitted by the lamp.

In an important embodiment of the invention, the function signal is a signal of constant magnitude. In such embodiment, either the spectral output in the characteristic region, or the ratio of the characteristic outputs in two spectral regions, is maintained constant. This is significant because when using a fill which is incompletely vaporized, due to unpredictable temperature variations of the bulb, in the absence of the invention, a constant or balanced spectral distribution is not maintained.

It is thus an object of the invention to provide a lamp unit having a controllable spectral distribution.

It is a further object of the invention to provide a lamp unit which provides a balanced or constant spectral distribution.

The invention will be better understood by referring to the accompanying drawings, in which.

Figure 1:
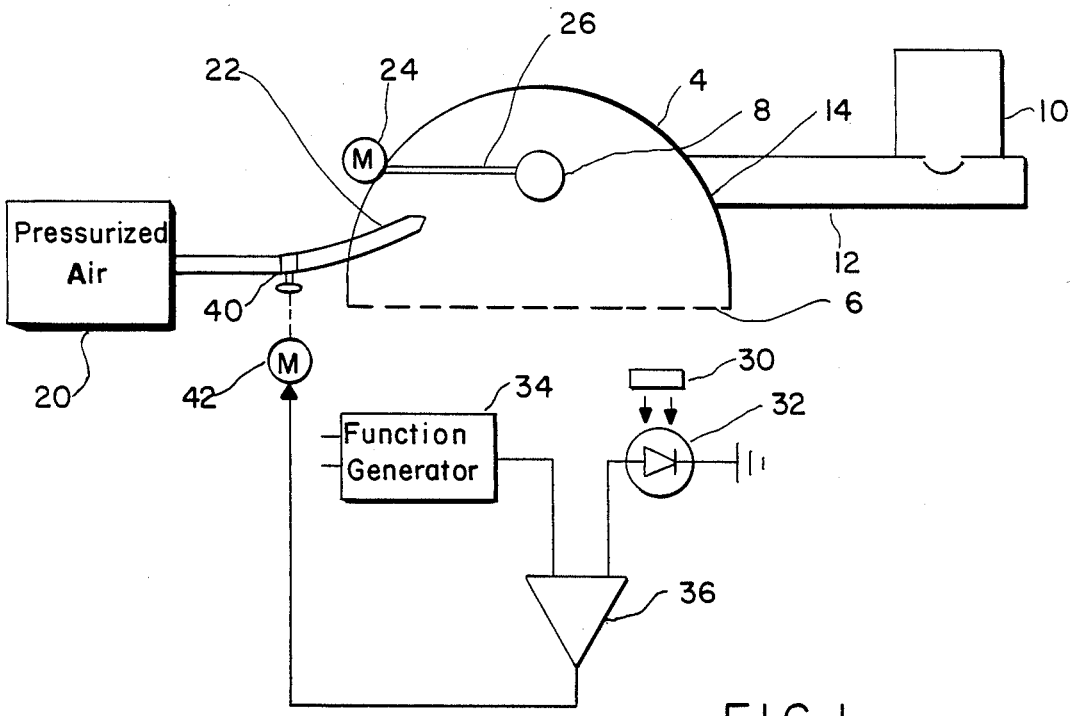
FIG. 1 is a schematic representation of an embodiment of the invention.

Referring to FIG. 1, a typical electrodeless lamp 2 is shown. The lamp is comprised of a microwave cavity which is made up of reflector 4, and mesh 6, which is effective to contain microwave energy while allowing light in the visible and ultraviolet ranges to exit.

A bulb 8 containing a suitable fill is disposed in the cavity. Microwave energy is generated by magnetron 10 and is fed via waveguide 12 to the cavity, where it enters through coupling slot 14. The microwave energy couples to bulb 8, and thereby generates a plasma which emits light, which is reflected by reflector 4 out of the cavity through mesh 6.

The bulb gets extremely hot during operation, and is cooled by impinging one or more streams of cooling gas, typically pressurized air, on it. Additionally, the bulb may be rotated while being impinged with cooling gas, as this substantially improves the cooling effect. In FIG. 1, pressurized air from source 20 is fed to nozzle 22, which impinges cooling gas on the bulb. Additionally, the bulb is rotated by motor 24 via bulb stem 26.

A possible fill for bulb 8 which emits radiation in the visible region would be comprised of mercury, indium chloride, tin iodide, and mercury chloride. As is known, a mercury only fill, which is commonly used in an electrodeless lamp emits primarily a line spectrum as opposed to a continuum, while the addition of the indium chloride, tin iodide, and mercury chloride provides for a visible continuum. The spectrum emitted by this lamp is strong in the blue region and weak in the red region.

Figure 3:
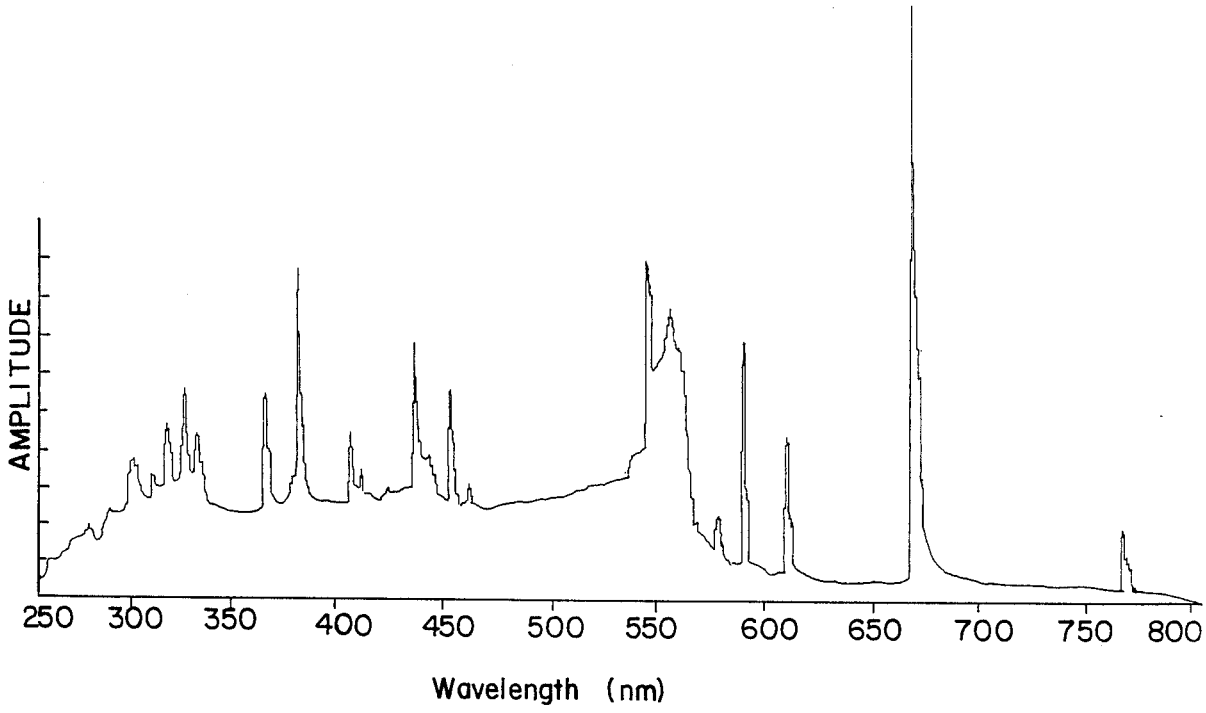
FIG. 3 shows a representative spectrum emitted by the lamp shown in FIGS. 1 and 2.

In accordance with the present invention, a substance is added to the fill which emits in the red region and which is not fully vaporized at the operating temperature of the lamp. This permits control of the spectral output in the red region by controlling the temperature of the lamp bulb. In the preferred embodiment of the invention, the substance added is a lithium halide, and its addition to the fill provides a spectral output which has good color balance. The spectrum which is provided by such fill is shown in FIG. 3.

Referring to FIG. 1, filter 30 is provided and is located so as to receive light from lamp 2. Filter 30 is a band pass filter which transmits light only in the red region of the spectrum, and is followed by photodetector 32 which generates a comparison signal.

Function generator 34 is also provided, which is capable of generating a preselected function signal of desired, arbitrary shape. The outputs of photodetector 32 and function generator 34 are fed to comparator 36, which generates a difference signal. This difference signal is fed back to the cooling fluid supply system to control the amount of cooling fluid impinging on the bulb.

For example, in FIG. 1, an exemplary control for the cooling fluid supply is a needle valve 40, the position of which is controlled by stepping motor 42. Alternatively, the input to pressurized air supply 20 could be throttled or the supply could be vented, to control cooling.

Thus, in accordance with the invention, whenever the output in the red region is different than that which has been programmed by function generator 34, a difference signal results, which causes the cooling of the lamp bulb 8 to vary, until the difference signal is at or approaches zero. For example, if there is too much red in the light output, which would be signified by the output of photodetector 32, referred to as the comparison signal, being greater than the function signal, the difference signal would be such to increase the cooling of the bulb, so as to condense more of the lithium halide fill substance to reduce the red output. On the other hand, if the light output had too little red, then the difference signal would be such so as to decrease the cooling so as to vaporize more of the lithium halide, and increase the output in the red region.

The spectral control which is provided by the invention is very flexible, since, as known to those skilled in the art, function generator 34 may be arranged to generate any function of arbitrary shape which is desired. For example, referring to FIG. 4, three exemplary functions 50, 52, and 54 are illustrated. In accordance with function 50, the output in the red spectral region would be held constant, while in accordance with functions 52 and 54 it would be respectively increased and decreased in a linear fashion. For example, it might be desired to use function 52 if the lamp were used for illuminating a motion picture scene in which it were desired to simulate the light of a setting sun, which would have an increasing red component.

In accordance with a further aspect of the invention, the ratio of the red spectrum magnitude and the green or blue magnitude is taken. The comparison signal which is inputted to the comparator is then based on this ratio, and a difference signal is generated when the comparison signal is different than the function signal, which is fed to the other input of the comparator. Thus, referring to FIG. 2, wherein like components are identified with the same reference numerals as in FIG. 1, band pass filter 42 is provided, which transmits light in the green or blue region, and such filter is followed by photodetector 44. The outputs of photodetectors 32 and 44 are fed to divider 46, the output of which is fed to comparator 36'. A function generator 34' is provided, and its output is also fed to an input of the comparator. As in the embodiment of FIG. 1, the output of the comparator is fed back to control the amount of cooling fluid which impinges on the lamp bulb 8'.

Figure 2:
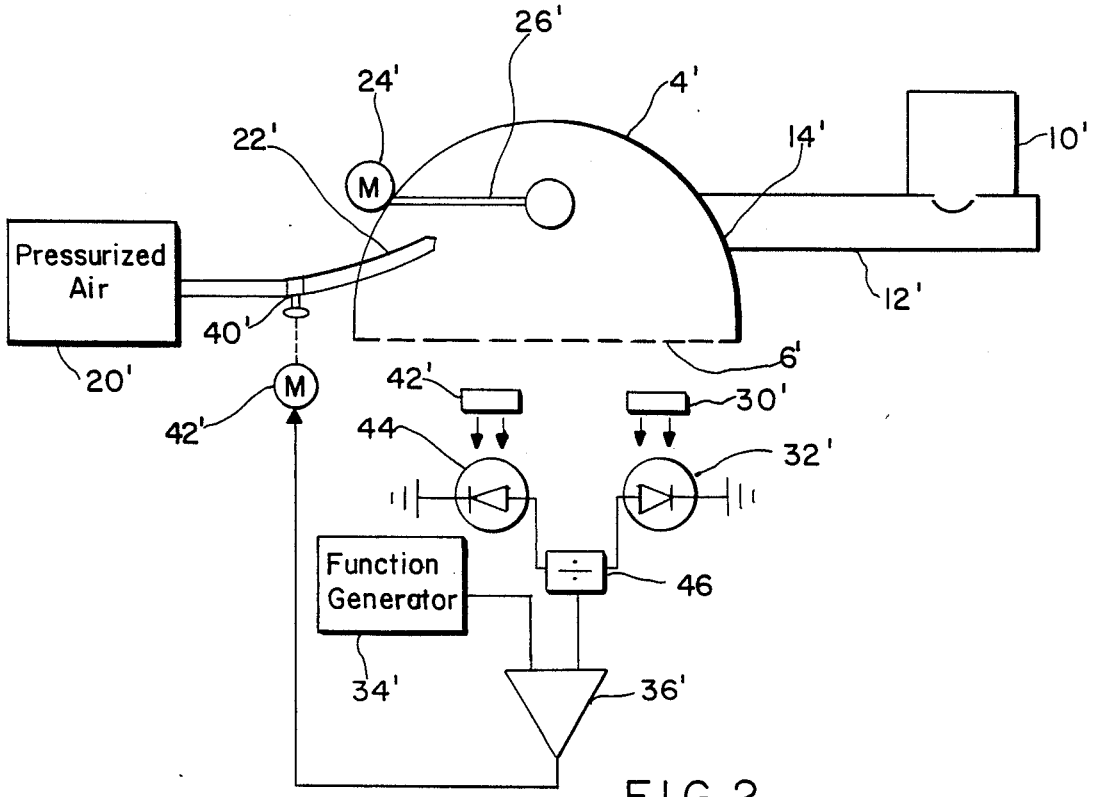
FIG. 2 is a schematic representation of a further embodiment of the invention.

The embodiment of FIG. 2 is very useful for exercising overall spectral control of the lamp output. Thus, when the temperature of the lamp bulb rises, the spectral output in the green/blue region also rises, although to a substantially lesser extent than the output in the red region. This is because that although the fill constituents which produce the green/blue output are fully vaporized, their vapor pressure increases to a certain extent with increasing temperature. In fact, with the fill described herein, the vapor pressures of all the fully vaporized constituents may change with temperature by about the same amount, so spectral balance, except for the red region, would be maintained with temperature changes. By monitoring the red/green ratio, and controlling the cooling of the bulb in accordance with the above-described difference signal, control of the color of the light is attained.

Figure 4:
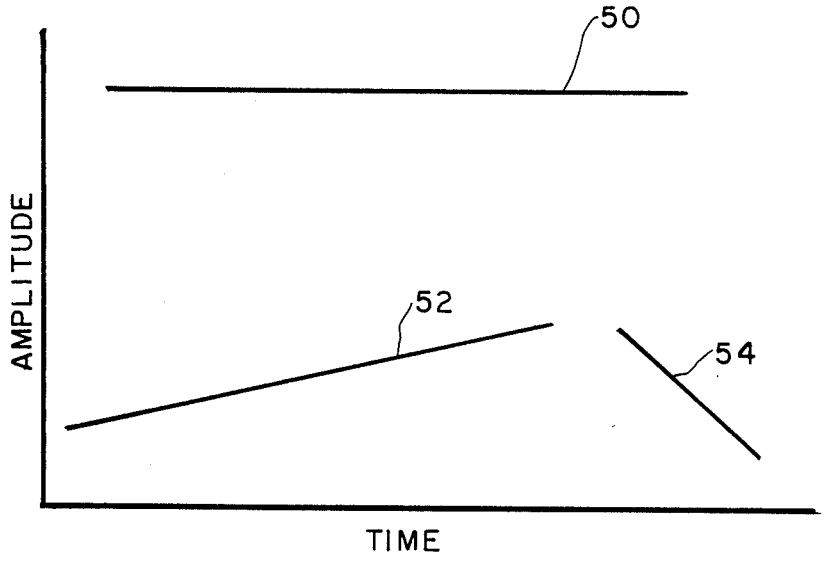
FIG. 4 shows possible function signals which may be generated by the function generator of FIGS. 1 and 2.

Referring to FIG. 4, it is noted that the object of function 50 is to hold the red/green ratio constant. This is an important embodiment of the invention because in many applications it is desired that spectral balance be maintained when bulb temperature changes. Such changes may be unintended, and may for example be due to fluctuations in input power or ambient temperature, as well as to bulb aging. Since the use of a fill substance which is not fully vaporized at the operating temperature, for example, lithium halide, may be the only way to achieve a desired spectrum, the significance of being able to maintain spectral balance in such a lamp can be appreciated.

For example, changes in the microwave power would have both a direct and indirect effect on light output, i.e., causing changes in intensity of the light and then causing temperature change which affects spectral balance. Thus, if the magnetron power decreases, the ratio of red to green drops as the bulb runs cooler, i.e., the light looks more green. The invention would measure this, and reduce the cooling air to maintain the color ratio, even though the overall output of the light may be reduced.

It should be noted that instead of using two filters and photodetectors as shown in FIG. 2, it may be possible to use three such detectors, for example, corresponding to the red, green and blue portions of the spectrum. In this case, two ratios instead of one could be used for spectral control, for example, red to green and red to blue, or if desired, three ratios could be used with the corresponding feedback to the temperature control to tend to maintain such ratios in correspondence with the function signal.

A specific fill which has been proposed for the lamp unit described herein would include 8.6 mg/ml of mercury 0.7 mg/ml of tin chloride ($SnCl_2$), 0.21 mg/ml of indium iodide ($InI_3$), 0.1 mg/ml of lithium iodide ($LiI_2$), 1.4 mg/ml of mercury iodide ($HgI_2$) and 90 torr of argon gas. It is estimated that the operating temperature range for this fill would be 800° C.–1,000° C., over which range the lithium halide would not be fully vaporized. Sodium iodide is another substance which could be used as the incompletely vaporized substance in connection with certain fills.

There thus has been provided a method and apparatus for controlling the spectral distribution of an electrodeless lamp.

It should be understood that while the implementation illustrated in FIGS. 1 and 2 utilizes analog electrical circuitry, digital circuitry and a digital processor is compatible with the principles of the invention and may also be used to accomplish the division, function generation, comparison, and feedback functions, and that the term "signal" is used herein encompasses digital values as well as analog signals.

Further, while the invention is described in connection with a lamp utilizing a particular substance which is not fully vaporized and for controlling spectral distribution in the visible region, it is not so limited, but rather is applicable to the use of any such substance which is not fully vaporized for maintaining spectral control in any predetermined part of the spectrum by controlling the temperature of a lamp having a fill which includes such incompletely vaporized substance for emitting in a region of such part of the spectrum.

Moreover, the invention may be usefully applied to cases in which more than one substance not fully vaporized at the operating temperature, is present. In general such substances would have different temperature coefficients of vapor pressure and the ratios of the quantities in the vapor phase will change with operating temperature. As a result, the balance of the spectral distribution or color will change with operating temperature. The invention is applicable to maintaining spectral control for such systems as well, by monitoring the spectral regions characteristic of each of the radiating species to provide the control or ratio control signals.

Finally, while the invention has been described in accordance with illustrative embodiments, it should be understood that variations will occur to those skilled in the art, and the scope of the invention is to be limited only by the claims appended hereto and equivalents.

What is claimed is:

1. In an electrodeless lamp system, a method of controlling the spectral distribution of the lamp output, comprising, providing an electrodeless lamp having a bulb which contains a fill which includes a substance which emits radiation in a characteristic region of the spectrum and which is not fully vaporized at the lamp operating temperature, impinging an amount of cooling gas on said bulb during operation which will cause said bulb to operate at such lamp operating temperature, detecting the magnitude value of the spectral output of the lamp in said characteristic region of the spectrum and generating a comparison signal based on said detected magnitude value, generating a function signal corresponding to a preselected function, and comparing said comparison with said function signal, and when the comparison signal is different than the function signal, changing the amount of cooling gas impinging on said bulb, until the comparison signal is equal to or approaches the function signal.

2. The method of claim 1, further including the steps of, detecting the magnitude value of the spectral output of the lamp in a different characteristic region of the spectrum, taking the ratio of said two detected magnitude values, and basing said comparison signal on said ratio of said detected magnitude values.

3. The method of claims 1 or 2 wherein the function signal is a signal of constant magnitude.

4. The method of claims 1 or 2 wherein the function signal is a signal which linearly increases in magnitude.

5. The method of claims 1 or 2 wherein said bulb fill contains constituents other than said substance emitting in said characteristic region of the spectrum, which constituents are fully vaporized at the lamp operating temperature.

6. The method of claim 4 wherein said substance emitting in said characteristic region of the spectrum is a lithium halide, and wherein said characteristic region is the red region of the spectrum.

7. The method of claim 6 wherein said lithium halide is lithium iodide.

8. The method of claim 7 wherein said different characteristic region of the spectrum is either the blue or green region of the spectrum.

9. The method of claim 6 wherein said constituents include mercury, an indium halide, and a tin halide.

10. The method of claim 9 wherein said lithium halide is lithium iodide, said indium halide is indium chloride, and said tin halide is tin iodide.

11. The method of claim 2, further including the steps of, detecting the magnitude value of the spectral output of the lamp in a third characteristic region of the spectrum, taking the ratio of either or both of said two magnitude values and said magnitude value associated with said third characteristic region of the spectrum and forming a ratio signal or signals corresponding thereto, generating a further function signal corresponding to a preselected function for each of said ratios which is taken, and comparing said ratio signal or signals with the corresponding further function signal or signals, and when there is a difference, changing the amount of cooling gas impinging on said bulb until the ratio signals are equal to or approach the function signals.

12. An electrodeless lamp system for controlling the spectral distribution of the lamp output, comprising, an electrodeless lamp having a bulb which contains a fill which includes a substance which emits radiation in a characteristic region of the spectrum and which is not fully vaporized at the lamp operating temperature, means for impinging an amount of cooling gas on said bulb during operation which will cause said bulb to operate at said lamp operating temperature, means for detecting the magnitude value of the spectral output of the lamp in said characteristic region of the spectrum, and for generating a comparison signal based on said magnitude value, means for generating a function signal corresponding to a preselected function, means for comparing said comparison signal with said function signal, and means for changing the amount of cooling gas impinging on said bulb when said comparison signal is different than said function signal, until the comparison signal equals or approaches the function signal.

13. The system of claim 12, further including, means for detecting the magnitude value of the spectral output of the lamp in a different characteristic region of the spectrum, and means for taking the ratio of said two detected magnitude values and for basing said comparison signal on said ratio of said magnitude values.

14. The system of claims 12 or 13 wherein said function signal is a signal of constant magnitude.

15. The electrodeless lamp system of claims 12 or 13 wherein said bulb fill contains constituents which emit radiation other than said substance emitting in said characteristic region of the spectrum, which constituents are fully vaporized at the lamp operating temperature.

16. The electrodeless lamp system of claim 15 wherein said substance emitting in said characteristic spectral region is a lithium halide, and wherein said characteristic region is the red region of the spectrum.

17. The electrodeless lamp system of claim 16 wherein said lithium halide is lithium iodide.

18. The electrodeless lamp system of claim 17 wherein said different characteristic region of the spectrum is the blue or green region of the spectrum.

19. The electrodeless lamp system of claim 18 wherein said constituents include mercury, an indium halide, and a tin halide.

20. The electrodeless lamp system of claim 19 wherein said lithium halide is lithium iodide, said indium halide is indium chloride, and said tin halide is tin iodide.

* * * * *